United States Patent [19]

Fukushima et al.

[11] 4,365,795

[45] Dec. 28, 1982

[54] SHEET ORTHOGONAL-CONVEYING METHOD AND DEVICE

[75] Inventors: Osamu Fukushima; Takashi Koizumi, both of Minami-ashigara, Japan

[73] Assignee: Fuji Photo Film Co., Ltd., Kanagawa, Japan

[21] Appl. No.: 198,040

[22] Filed: Oct. 17, 1980

[30] Foreign Application Priority Data

Oct. 22, 1979 [JP] Japan ..... 54/136076

[51] Int. Cl.[3] ..... B65H 9/00

[52] U.S. Cl. ..... 271/236; 271/146; 271/242; 271/243; 271/272

[58] Field of Search ..... 271/242, 243, 244, 236, 271/238, 240, 250, 227, 228, 265, 18, 226, 146, 272, 273, 274, 118, 229, 239, 245, 246, 264, 8 R; 250/468; 193/17

[56] References Cited

U.S. PATENT DOCUMENTS

| | | | |
|---|---|---|---|
| 1,261,998 | 4/1918 | Anderson | 271/244 |
| 3,288,461 | 11/1966 | Smith | 271/265 X |
| 3,350,091 | 10/1967 | Masterson et al. | 271/240 |
| 3,545,741 | 12/1970 | Porth | 271/146 X |
| 4,150,743 | 4/1979 | Lazzarotti et al. | 271/18 X |
| 4,167,673 | 9/1979 | Stievenart et al. | 271/242 X |

FOREIGN PATENT DOCUMENTS

| | | | |
|---|---|---|---|
| 2343364 | 3/1975 | Fed. Rep. of Germany | 271/246 |

*Primary Examiner*—Bruce H. Stoner, Jr.
*Attorney, Agent, or Firm*—Sughrue, Mion, Zinn, Macpeak & Seas

[57] ABSTRACT

A sheet orthogonal-conveying method and apparatus in which the front edge of a sheet sliding under its own weight is delivered into the nip formed between a pair of rollers orthogonal to the direction of advancement of the sheet. The sheet is first guided so that its front edge slides into contact with the side edge of one of the rollers, preferably the upper one of the rollers, at a position away from the nip. After the sheet has reached a stationary position stopped by the roller, the position of the guide has changed so that the sheet may slide into the nip and be clamped and conveyed by the rollers. Preferably, the sheet is vibrated during this operation. An elastic guide piece may be utilized to urge the sheet toward a reference surface of the guide member.

10 Claims, 10 Drawing Figures

SHEET ORTHOGONAL-CONVEYING METHOD AND DEVICE

BACKGROUND OF THE INVENTION

The present invention relates to a method for conveying sheets in which a sheet guided upon sliding downward under its own weight is positioned with its front edge orthogonal to the direction of advancement of the sheet and is then conveyed with two opposed rollers or a pair of rollers. Such a method is hereinafter referred to as "a sheet orthogonal-conveying method". The invention also relates to a device for practicing the method, hereinafter referred to as "a sheet orthogonal-conveying device".

An operation of conveying a sheet with a pair of rollers, the sheet sliding under its own weight, is used in releasing exposed X-ray picture film sheets from a cassette 1 as shown in FIG. 1. A released film sheet 2 slides down a guide member 3 and its front edge is introduced between a pair of rollers 4 and 5. The film sheet 2 is then conveyed by rotation of the rollers 4 and 5 to the following process position such as for exposure printing with an ID card or developing. In this connection, it is desirable that the front edge of the film sheet 2 conveyed with the pair of rollers be orthogonal to the direction of advancement or conveyance of the sheet. This is essential for the case where the sheet is subjected to exposure printing with an ID card so that the image is printed at a predetermined position on the sheet.

A conventional method for conveying a sheet which has slid under its own weight with a pair of rollers with the front edge of the sheet orthogonal to the direction of advancement of the sheet is such that the front edge of the sheet is made orthogonal with the direction of advancement of the sheet when it is stopped along the nip region of the two rollers. The sheet is conveyed by rotation of the rollers which is started following a time delay after the front edge has been brought into contact with the rollers. This method is an application of the technique described in the specification of Japanese Laid-Open patent application No. 112366/1974, for instance.

However, the conventional method is disadvantageous in the following points. In the case where a sheet slides down at high speed or a sheet is thin and rigid to some extent, sometimes the sheet penetrates unevenly into the nip region of the rollers. That is, one of the right and left ends of the front edge of the sheet goes into the nip region more deeply than the other with the result that the front edge is not orthogonal with the direction of advancement of the sheet.

In order to overcome this difficulty, a technique has been disclosed in Japanese Laid-Open patent application No. 79682/1977. With this technique, after the front edge of a sheet strikes against a pair of rollers, the rollers are turned in the opposite direction to prevent the front edge from going into the nip region of the rollers deeply and to set the front edge straightly along the nip region, that is, to make the front edge orthogonal to the direction of advancement of the sheet. Then the rollers are turned in the forward direction to convey the sheet. In this method, in the course of making the front edge of the sheet orthogonal to the direction of advancement of the sheet, sometimes the corners of the sheet are shifted along the nip region of the rollers in the wedge-shaped space of the nip region. Because of this, it takes a relatively long time to make the front edge orthogonal to the direction of advancement of the sheet because of frictional resistance which is caused when the corners of the sheet are shifted as described above. With a sheet curled to some extent, sometimes one of the ends of the front edge of the sheet goes further into the wedge-shaped space than the other and this state is maintained unchanged for a time with the result that the front edge of the sheet is immediately not made orthogonal to the direction of advancement of the sheet.

Accordingly, an object of the invention is to provide a sheet orthogonal-conveying method in which the difficulty accompanying a conventional method that the front edge of a sheet sliding down under its own weight goes into the nip region of a pair of rollers deeply is eliminated and even a sheet curled to some extent can be conveyed with its front edge orthogonal to the direction of advancement of the sheet.

SUMMARY OF THE INVENTION

The foregoing object and other objects of the invention have been achieved by the provision of a method for orthogonally conveying sheets in which a sheet guided while sliding under its own weight is positioned with its front edge orthogonal to the direction of advancement of the sheet and is then conveyed with a pair of rollers, wherein, according to the invention, the front edge of the sheet is brought into contact with one of the pair of rollers so that the sheet stops at the one roller with the front edge thereof orthogonal to the direction of advancement of the sheet after which the front edge of the sheet is introduced between the pair of rollers.

In accordance with the method of the invention, a sheet released from the cassette or delivered by a delivering mechanism to a position higher in level than the nip line of a pair of rollers so as to slide under its own weight is detained by one roller of the pair of rollers whereby the front edge of the sheet is set along the generating line of the cylindrical roller after which the sheet is introduced between the rollers. The roller for firstly receiving the sheet may be either the upper roller or the lower roller. The upper roller may be selected to allow the sheet with the front edge orthogonal to the direction of advancement of the sheet to further slide down under its own weight into the nip formed between the rollers and which the lower roller may be selected to introduce the sheet with the front edge orthogonal to the direction of advancement of the sheet between the rollers utilizing the rotation of the rollers. Additionally, the sheet may be vibrated or one side edge of the sheet may be depressed sidewardly with an elastic piece in combination with the above-described method so that the front edge of the sheet can be more effectively made orthogonal with the direction of advancement of the sheet.

DESCRIPTION OF THE PREFERRED EMBODIMENTS

The invention will be described with reference to FIGS. 2 through 8A.

Figure 1:
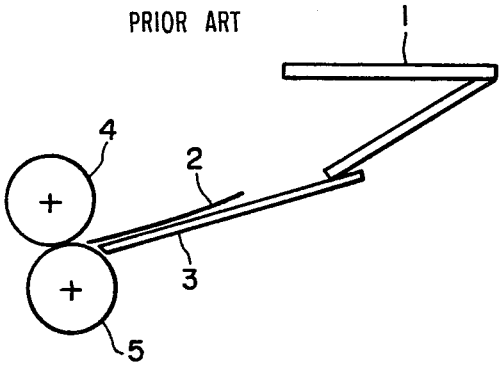
FIG. 1 PRIOR ART
FIG. 1 is a side view of a conventional device for introducing to a pair of rollers a sheet sliding under by its own weight.
Figure 2:
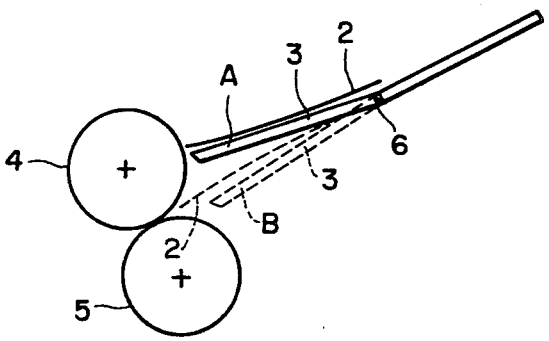
FIG. 2 is a side view of a first embodiment of a sheet conveying device of the invention.

A first embodiment of a sheet orthogonal-conveying device constructed according to the invention is shown in FIG. 2. In the device, a guide member 3 is provided which is displaceable between a first position A indicated by solid lines and a second position B indicated by dashed lines. When the guide member 3 is at the position A, the front edge of a sheet 2 sliding down the guide member 3 comes into abutment with an upper roller 4 which is paired with a lower roller 5 and the sheet 2 is stopped by the upper roller 4. When the guide member is at the position B, the front edge of the sheet stopped by the upper roller is introduced between the pair of rollers 4 and 5. The guide member 3 is rotatably supported at a support point 6 and initially is set at the first position A.

With this construction, the front edge of a sheet 2 sliding down the guide member 3 strikes the circumferential wall of the roller 4 and is then brought into contact with the generating line of the cylindrical roller 4. That is, the sheet 2 is stopped with its front edge orthogonal to the direction of advancement of the sheet. The time interval which elapses from the time instant that the front edge of the sheet 2 strikes the roller 4 until the sheet 2 is stopped with its front edge orthogonal to the direction of advancement of the sheet is of the order of 0.5 to 3 seconds. After the sheet 2 is stopped, the guide member 3 is turned to the second position B. As a result, the sheet 2 is allowed to slide down again and the front edge of the sheet 2 is introduced between the rollers 4 and 5. The speed of the sheet sliding down the guide member 3 at this time is low and therefore the sheet will not slide into the nip region of the rollers 4 and 5. As the front edge of the sheet 2 is brought into contact with the nip region, the sheet 2 is set with its front edge forming a right angle with the sheet advancement direction. When the sheet is in this position, the rollers 4 and 5 are turned to convey the sheet. The sheet will not be inclined during the period that the sheet is stopped at the roller 4 with its front edge orthogonal to the sheet advancement direction.

The rollers 4 and 5 may be maintained rotated throughout the operation. In this case, in order that the sheet 2 is not conveyed by the rotation of the roller 4 when its front edge is in contact with the roller 4, it is necessary to make the distance between the guide member 3 and the roller sufficiently small or the position A should be so selected that the angle formed by the guide surface of the guide member 3 and the cylindrical wall of the roller 4 is not small. In the case where the pair of rollers are rotating throughout the operation, the sheet 2 is allowed to further slide down upon displacement of the guide member 3 to the second position B from the first position A. Its front edge is then brought into contact with the rotating roller 5. It should be noted that the front edge is uniformly brought into contact with the roller 5 in the axial direction of the roller because it is oriented orthogonal to the sheet advancement direction and therefore the sheet will not be inclined. The device may be so designed that first the rollers 4 and 5 stop then start rotation again when the guide member 3 is shifted from the first position A to the second position B.

Figure 3:
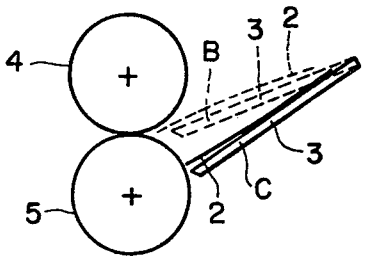
FIG. 3 is a side view of a second embodiment of a sheet conveying device of the invention.

A second embodiment of a device constructed according to the invention is shown in FIG. 3. In this embodiment, the guide member 3 is shifted between a first position C indicated by the solid line and a second position B. When the guide member 3 is at the first position C, the front edge of a sheet 2 sliding down the guide member comes into contact with a lower roller 5 which is paired with an upper roller 4 and the sheet 2 is detained by the lower roller 5. When the guide member 3 is at the second position B, the front edge of the sheet 2 is introduced between the rollers 4 and 5.

Figure 4:
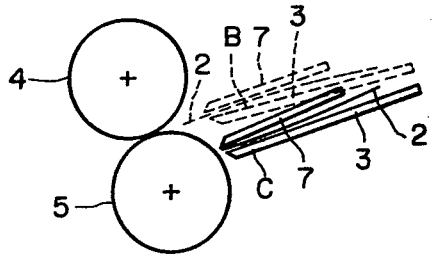
FIG. 4 shows a modification of the second embodiment shown in FIG. 3.

When the guide member 3 is at the first position C, the front edge of the sheet sliding down the guide member 3 strikes the generating line of the cylindrical lower roller 5 whereby the sheet is stopped with its front edge orthogonal to the sheet advancement direction. Therefore, the guide member 3 is shifted to the second position B. As a result, the front edge of the sheet 2 is shifted along the surface of the roller 5 and therefore the sheet is allowed to slide further. Finally, the front edge of the sheet 2 is guided into the nip between the rollers 4 and 5. The operation after this is the same as that in the first embodiment shown in FIG. 2. If the pair of rollers 4 and 5 are maintained rotating, in order that the sheet 2 is not conveyed by the rotation of the roller 5 when it is brought into contact with the roller 5, the first position C should be so selected that the guide surface of the guide member 3 and the circumferential wall of the roller 5 form a small angle or a limiting guide member 7 should be provided above the guide member 3 as shown in FIG. 4 with the limiting guide member 7 shifted with the guide member 3.

Figure 5:
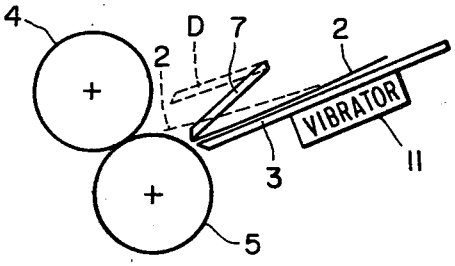
FIG. 5 is a side view of a third embodiment of a sheet conveying device of the invention.

A third embodiment of a device constructed according to the invention as shown in FIG. 5 includes a guide member 3 for guiding a sheet sliding under its own weight so that the front edge of the sheet is brought into contact with a lower roller 5 which is paired with an upper roller 4 to stop the sheet 2. A limiting guide member 7 is provided above the guide member 3 which is retractable to a position D indicated by dashed lines.

The front edge of the sheet sliding down the guide member 3 is brought into contact with the roller 5 and the sheet 2 is stopped with its front edge orthogonal to the sheet advancement direction. Thereafter, the limiting guide member 7 is shifted to the position D. As a result, the sheet 2 falls into the nip formed between the rollers 4 and 5 and is advanced by rotation of the rollers 4 and 5. The rollers 4 and 5 may be maintained rotating. Alternatively, the device may be so designed that first the rollers 4 and 5 are stopped then started again after the limiting guide member 7 has been retracted to the position D.

Figure 6:
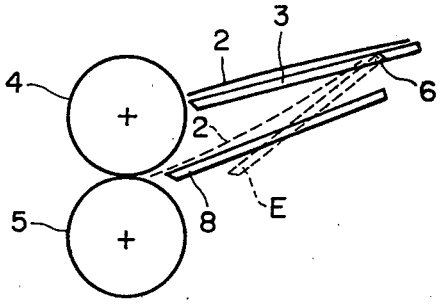
FIG. 6 is a side view of a fourth embodiment of a sheet conveying device of the invention.

FIG. 6 shows a fourth embodiment of a device according to the invention. The fourth embodiment includes a guide member 3 for guiding a sheet 2 so that its front edge is brought into contact with an upper roller 4 which is paired with a lower roller 5 to stop the sheet 2 and a guide member 8 for guiding the sheet 2 so that the front edge thereof is clamped by the rollers 4 and 5. The guide member 3 is retracted to a position E indicated by dashed lines so that the sheet 2 is transferred to the guide member after the front edge of the sheet 2 sliding down the guide member 3 is brought into contact with the upper roller 4 to stop the sheet. The guide members 3 and 8 are each in the form of a comb so that they can cross each other. When the guide member 3 is retracted to the position E, the sheet 2 brought into contact with the roller 4 with the front edge of the sheet orthogonal to the sheet advancement direction is dropped onto or transferred to the guide member 8 from the guide member 3.

In the above-described embodiments of devices constructed according to the invention, the sheet may be vibrated with a vibrator of a type disclosed, for example, in the specification of Japanese Laid-Open Utility Model Applications Nos. 149671/1977, 53774/1978 and 31681/1979. Vibration is applied to the sheet 2, for instance, by a vibrator 11 attached to the guide member 3 as shown in FIG. 5, before the sheet 2 is brought into contact with one of the pair of rollers 4 and 5 with its front edge orthogonal to the sheet advancement direction. Alternatively, the sheet 2 may be vibrated while the sheet 2 is being introduced between stopped rollers 4 and 5 with the front edge lying along the nip region of the rollers 4 and 5.

FIGS. 7A and 7B and FIGS. 8A and 8B show a fifth embodiment of a device according to the invention which utilizes a technique disclosed by Japanese Utility Model Application No. 87778/1979 filed by the present applicant.

In the fifth embodiment of the invention, the technique of the first embodiment shown in FIG. 2 is employed and an elastic piece 9 is provided so as to shift one side edge of a sheet 2 on the guide member 3 to a reference side 10 provided on the guide member whereby the sheet 2 is set with its front egde orthogonal to the sheet advancement direction and simultaneously the sheet 2 is positioned correctly in its lateral direction. In this embodiment, the sheet 2 may also be vibrated with a vibrator.

Figure 7A:
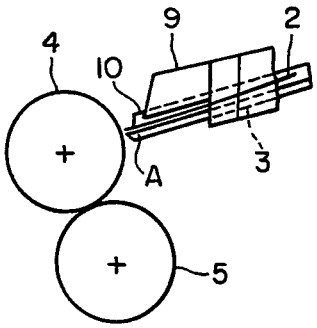
FIGS. 7A and 8A are side views of a fifth embodiment of a sheet conveying device of the invention in two different operative positions.
Figure 7B:
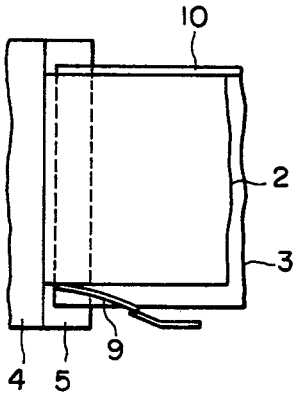
FIGS. 7B and 8B are plan views of the device of the fifth embodiment of the invention corresponding to FIGS. 7A and 8A, respectively.

A biasing force should be applied to the elastic piece 9 for shifting a sheet 2 to the reference side 10. If the sheet is moved between the rollers 4 and 5 after the front edge of the sheet 2 has been brought into contact with the roller 4 to stop the sheet 2 with the front edge orthogonal to the sheet advancement direction and if the size of the sheet 2 is relatively small and hence the frictional force of the elastic piece 9 is larger than the energy of advancing the sheet, it is difficult for the sheet 2 to advance. Accordingly, the device should be so designed that the elastic piece 9 is in contact with the sheet 2 only when the guide member 3 is at the first position A and the elastic piece 9 is disengaged from the sheet 2 when the guide member is shifted to the second position B. FIGS. 7A and 7B shows a state of the device in which the guide member 3 is disposed at the first position A. With this structure, the sheet 2 slides down the guide member while being positioned in its lateral direction so that one side edge thereof is held in contact with the reference side 10 by a force applied by the elastic piece 9. As a result, the front edge of the sheet is brought into contact with the roller 4 to stop the sheet 2 with the front edge orthogonal to the sheet advancement direction. In this operation, the front edge will more quickly be made orthogonal if vibration is also applied.

Figure 8A:
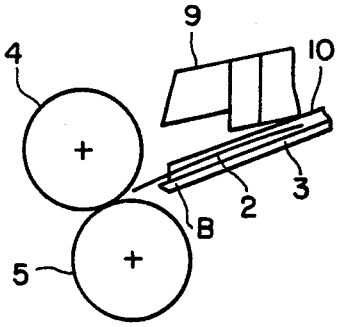
Figure 8B:
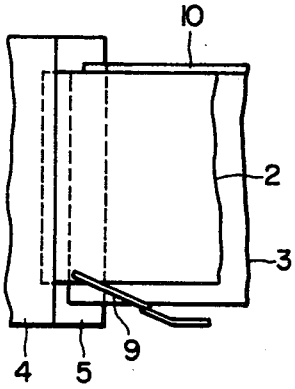

Thereafter, the guide member 3 is shifted to the second position B as shown in FIGS. 8A and 8B. Upon shifting of the guide member 3 to the second position, the sheet 2 is lowered with the guide member 3 away from the elastic piece 9 and therefore the sheet 2 is advanced and introduced into the nip formed between the rollers 4 and 5.

In the embodiments of the device shown in FIGS. 2 through 8B, displacement of the guide member or the limiting guide member and rotation of the rollers can be achieved with a conventional drive structure in which the position of the sheet is detected in a conventional manner. For instance, the device may be so designed that the front edge of a sheet sliding down the guide member is detected with a limit switch or a photoelectric detecting device and the relevant mechanisms are operated with predetermined time delays after detection.

In the sheet orthogonal-conveying method of the invention, as described above, a sheet sliding down under its own weight is introduced between a pair of rollers after the front edge of the sheet has been brought into contact with one of the rollers to stop the sheet with the front edge thereof orthogonal to the sheet advancement direction. Therefore, the difficulty accompanying the conventional method that the front edge of a sheet sliding under its own weight goes directly into the nip of the rollers is eliminated with the use of the invention. In accordance with the method of the invention, the front edge of a sheet is oriented orthogonal to the sheet advancement direction before it is introduced between the pair of rollers. Therefore, even a sheet curled to some extent can be oriented with the front edge orthogonal to the sheet advancement direction.

What is claimed is:

1. A sheet orthogonal-conveying method in which a sheet guided while sliding under its own weight is positioned with the front edge thereof orthogonal to the direction of advancement of said sheet and is then conveyed with a pair of rollers comprising the steps of: sliding said sheet downwardly at an angle such that the front edge of said sheet sliding down under its own weight comes in contact with a smooth surface of one roller of said pair of rollers so that said sheet is stopped by said one roller with said front edge orthogonal to said direction of advancement; and reorienting a plane of said sheet to introduce said front edge of said sheet between said pair of rollers to be conveyed thereby in said direction of advancement.

2. The method as claimed in claim 1 further comprising the step of vibrating said sheet at least one of when said front edge of said sheet is in contact with said one roller and when said sheet is in contact with both rollers of said pair of rollers.

3. The method as claimed in claim 1 or 2 further comprising the step of depressing one side edge of said sheet while said front edge of said sheet is brought into contact with said one roller so that said sheet is moved sidewardly.

4. The method as claimed in claim 1 or 2 wherein said one roller is the upper roller of said pair of rollers.

5. A sheet orthogonal-conveying device in which a sheet sliding down under its own weight is positioned with the front edge thereof orthogonal to the direction of advancement of said sheet and is then conveyed with a pair of rollers comprising: a pair of rollers having smooth surfaces, a nip being continuously formed between said rollers, and said rollers being rotated in a direction so as to convey said sheet in said direction of advancement; and a guide member for disposing said first edge of said sheet sliding down into contact with one roller of said pair of rollers at an angle so as to stop said sheet, said guide member being shiftable to a position to introduce said sheet into said nip between said pair of rollers after said front edge of said sheet has been brought into contact with said one roller to stop said sheet.

6. The device as claimed in claim 5 wherein said guide member is shiftable between a first position and a second position so that, when said guide member is at said first position, said guide member guides said sheet in such a manner that said front edge of said sheet is brought into contact with said one roller to stop said sheet, and when said guide member is at said second position, said guide member guides said sheet in such a manner that said front edge of said sheet is clamped by said pair of rollers.

7. The device as claimed in claim 5 wherein said guide member comprises: a first guide member for guiding said sheet sliding down under its own weight in such a manner that the front edge of said sheet is brought into contact with the upper one of said pair of rollers to stop said sheet and a second guide member for guiding said sheet in such a manner that said front edge of said sheet is clamped by said pair of rollers, said first guide member being retracted after the front edge of said sheet sliding down said first guide member has been brought into said one roller to stop said sheet.

8. A sheet orthogonal-conveying device in which a sheet sliding under by its own weight is positioned with the front edge thereof orthogonal to the direction of advancement of said sheet and is then conveyed with a pair of rollers comprising: a pair of rollers having smooth surfaces, a nip being continuously formed between said rollers, and said rollers being rotated in a direction so as to convey said sheet in said direction of advancement; a guide member for guiding said sheet in such a manner that said front edge of said sheet is brought into contact with a lower roller of said pair or rollers to stop said sheet; and a limiting guide member disposed above said guide member, said limiting guide member being retracted, after said front edge of said sheet is in contact with said lower roller, so that said sheet is clamped by said pair of rollers as said lower roller rotates.

9. The device as claimed in any of claims 5–8 further comprising an elastic piece for shifting said sheet to a reference side of said guide member, said elastic piece being stationarily positioned such that said elastic piece is not in contact with said sheet when said sheet is clamped by said pair of rollers.

10. The device of any of claims 5–8 further cmprising means for vibrating said sheet prior to said sheet being clamped by said rollers.

* * * * *